US006188047B1

(12) United States Patent
White et al.

(10) Patent No.: US 6,188,047 B1
(45) Date of Patent: Feb. 13, 2001

(54) RADIANT ELECTRIC HEATER

(75) Inventors: Steven M. White, Morristown; David H. Scott, Bristol, both of TN (US)

(73) Assignee: Minpat Co., Wilmington, DE (US)

( * ) Notice: Under 35 U.S.C. 154(b), the term of this patent shall be extended for 0 days.

(21) Appl. No.: 09/439,448

(22) Filed: Nov. 15, 1999

(51) Int. Cl.[7] ..... H05B 3/68; C23C 3/00

(52) U.S. Cl. ..... 219/460.1; 219/461.1; 501/11

(58) Field of Search ..... 219/451.1, 452.11, 219/460.1, 461.1, 465.1, 467.1; 501/11, 12, 84, 133

(56) References Cited

U.S. PATENT DOCUMENTS

| | | | | |
|---|---|---|---|---|
| 3,656,983 | * | 4/1972 | Sulinski | 106/38.3 |
| 3,737,624 | * | 6/1973 | Eilenberger | 219/525 |
| 4,221,672 | * | 9/1980 | McWilliams | 219/460.1 |
| 4,954,327 | * | 9/1990 | Blount | 106/18.12 |

* cited by examiner

*Primary Examiner*—Sang Paik
(74) *Attorney, Agent, or Firm*—John F. McDevitt

(57) ABSTRACT

The insulation component of a radiant electric heater device formed with fused silica particulates is combined in the device during its construction. Final preparation of the insulation takes place after assembly in a metal dish of the device.

21 Claims, 1 Drawing Sheet

Fig. 1
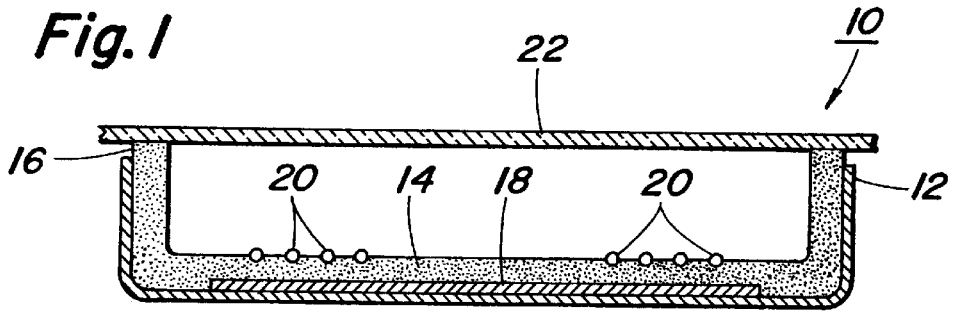
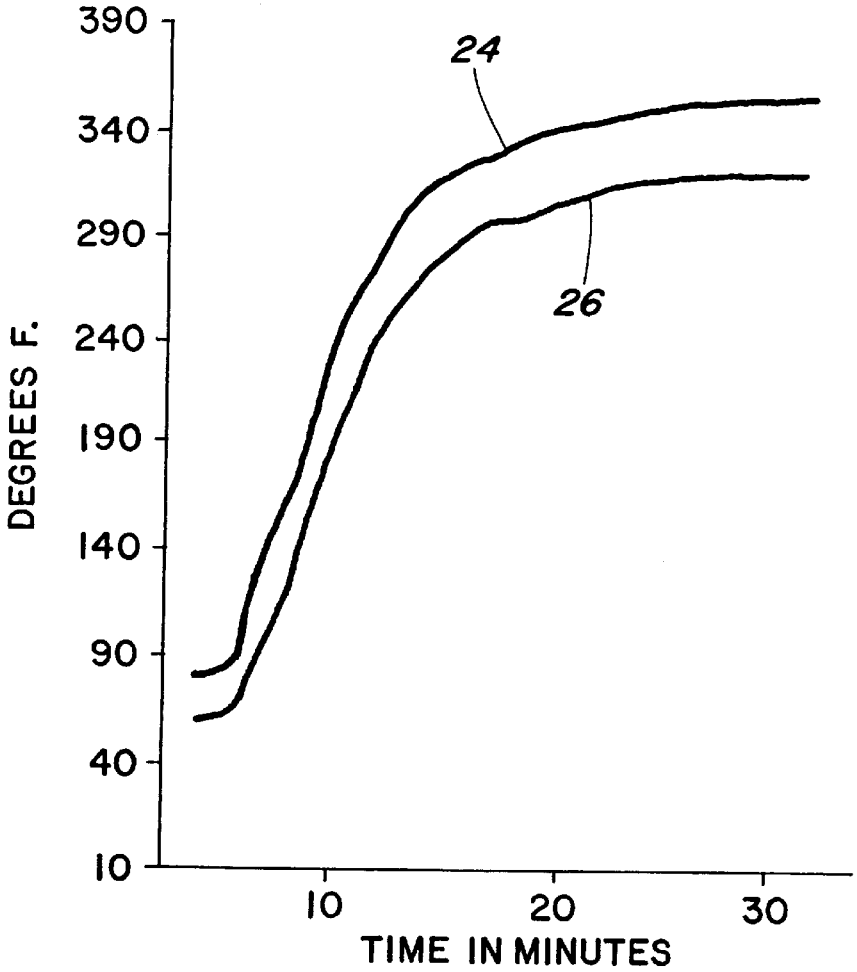
Fig. 2

RADIANT ELECTRIC HEATER

BACKGROUND OF THE INVENTION

This invention relates to a novel radiant electric heater utilizing fused silica particulates for thermal and electrical insulation and more particularly to a novel construction for the device.

Radiant electric heaters intended for top surface cooking appliances now employ "microporous" type colloidal silica insulation which can be molded or otherwise formed to provide the base component in said device when customarily supported in a metal dish. For example, there is disclosed in U.S. Pat. No. 5,302,444 a radiant electric heater having such colloidal silica insulation which is said to have an extremely minute particle size no greater than about 100 nanometers diameter together with limited porosity dictated by the same pore size. The particular radiant heater device therein described further includes a two-part construction for the insulation component with a base layer of the insulation material being physically supported in the metal dish and a separate ring-shaped insulation layer resting atop said base insulation layer. Further description of other customary radiant heater constructions of this type are found in U.S. Pat. No. 5,471,737, U.S. Pat. No. 5,512,731 and U.S. Pat. No. 5,517,002 which all require such insulation in order to avoid overheating during device operation. A still further description for preparation of a satisfactory microporous insulation of this type can be found in U.S. Pat. No. 5,556,689 which includes a requirement for a very high specific surface area of the minute oxide particulates being employed for adequate thermal insulation.

In U.S. Pat. No. 3,737,624 there is described an electric grill employing dissimilar thermal and electrical insulation formed with multiple insulation layers interleaved by aluminum reflecting foil to improve heating efficiency. The resistance heating element in said device is also formed by directly depositing a high resistivity metal alloy on the top insulation layer.

The above referenced colloidal silica insulation in prior art radiant electric heaters also remains relatively expensive due to costs of preparation including needed raw materials, processing requirements and still other factors limiting availability. Thus, a preparation of suitable microporous insulation according to the foregoing references can involve elaborate processing techniques such as gel formation, controlled precipitation and fume deposition in order to control average particle size and limited porosity no greater than 100 nanometers maximum. It becomes desirable, therefore, to replace conventional microporous insulation now being used in radiant electric heaters by means which are far less costly and more readily available as well as enabling the device itself to be constructed in an improved manner. As can be further noted in the aforementioned prior art references, the conventional colloidal silica insulating material being employed is also customarily processed entirely in a dry state producing a molded or compressed solid form having the final physical shape desired in said radiant heater device. It has now been discovered that an improved material composition and physical form for said insulation permits construction of the radiant heater device in a manner more readily adapted to automated manufacture. In doing so, the modified insulating material utilizes fused silica of the type conventionally produced in a rotary electric arc furnace (such as disclosed in U.S. Pat. No. 4,217,462) and thereafter mechanically reduced by conventional means to produce a suitable particle size for utilization in accordance with the present invention. It remains only required with said substituted fused silica insulation to further include metal heat shield means in a manner to be disclosed hereinafter for satisfactory retention of heat within the radiant heater device during its operation.

It is an important object of the present invention, therefore, to provide a radiant electric heater constructed in a novel manner.

It is another object of the present invention to provide a novel radiant electric heater employing fused silica particulates as the thermal and electrical insulation means when combined in the device in a novel manner.

Still another object of the present invention is to provide a novel radiant electric heater employing fused silica particulates as the thermal and electrical insulation means together with a modified device construction which further includes combination with operatively associated heat shield means.

These and still further objects of the present invention will become more apparent upon considering the following detailed description of the present invention.

SUMMARY OF THE INVENTION

Fused silica particulates have now been found to provide effective thermal and electrical insulation means when disposed as a base component in the radiant electric heater device. The desired porous characteristic of the present fused silica insulation is provided with a solid mass of the fused silica particulates having an average particle size up to about 100 mesh United States screen size and with said porous characteristic being formed by open void spaces existing between the individual non-porous silica particles. The solid insulation can be prepared in various ways from a foamed liquid suspension of the fused silica particulates further containing a suitable foaming agent, such as an organic surfactant, a conventional phosphate soap or the like. To form a sufficiently stabilized foam in the liquid suspension for further processing in accordance with the present invention, the liquid suspension can be physically agitated at ordinary ambient temperatures with mechanical means such as a conventional high speed rotary blender, to produce the desired frothy condition. Alternately, a foam condition in the liquid suspension can be produced employing other already known conventional means such as air pressure combined with mechanical screens to produce small bubbles in the discharged liquid medium. The foamed liquid suspension can thereafter be deposited in the metal dish forming the bottom member in the present device for additional processing steps required to produce the final solid insulation as well as further processed separately in the same or similar manner before such combination takes place. In such manner, the present base layer of solid insulation material can be formed as a flat pad having a resistance heating element disposed on or embedded in its top surface while further having a metal heat shield, such as aluminum foil, being interposed between its bottom surface and the metal dish member for the purpose of reflecting heat energy back into the insulation and thereby help prevent heat escape from the device. Construction of the present radiant heater device further contemplates multiple layers of the solid fused silica insulation being physically separated with additional metal heat shields as well as having the metal heat shield component being physically embedded in the bottom surface of said insulation material. Improved construction of a radiant electric heater device is still further facilitated with use of the present fused silica insulation. More particularly, by having the fused silica insulation being formed according to the present invention its final physical shape can now be molded in a single unitary operation. It is thereby contemplated to form said base layer of insulation in the present radiant heater device as a flat pad having an integral upward extending rim for the purpose of physically supporting external structure customarily joined to said device in a glass ceramic cooking surface appliance and the like.

The present insulation means in the present radiant electric heater construction is formed in a particular manner producing a foamed type open lattice in the disposed fused silica particulates. The desired porous characteristic of said insulation is produced upon first preparing a foamed liquid suspension of the fused silica particulates with a foaming agent then converting the foamed liquid suspension to a gel condition and finally removing liquid from the converted gel mass of fused silica particulates after having been deposited in the metal dish of said radiant heater device. In one aspect of the present invention, the present radiant electric heater is constructed having a metal dish containing a base layer of the thermal and electrical insulation, a metal heat shield interposed between said insulation material and said metal dish, and a resistance heating element physically supported by said insulation material, said insulation material comprising a solid porous mass of fused silica particulates formed in situ in the metal dish, said fused silica particulates having an average particle size up to about 100 mesh United States screen size and with the porous characteristic being formed by void spaces between the fused silica particulates, and with said solid porous mass of fused silica particulates having been formed by first preparing a foamed liquid suspension of the fused silica particulates with a foaming agent then converting the foamed liquid suspension to a gel condition and finally removing liquid from the converted gel mass of fused silica particulates after having been deposited in the metal dish. A representative method for preparation of a suitable foamed liquid suspension required to form the present insulation material simply mixes the finely divided fused silica particles and the foaming agent together at ambient room temperature conditions for subsequent physical agitation of the mixture sufficient to produce a frothy condition therein. For example, the fused silica particulates are mixed together in water with a high foaming organic surfactant such as Triton X301 and a colloidal silica binder such as Bindzel 30/A360 while being mechanically agitated sufficiently to produce a frothy condition in the liquid mixture. Optional inclusion of a water soluble resin in minor amounts of 0.05 weight percent has been found to desirably improve stability of said foamed liquid suspension. Gelling of the foamed liquid suspension before bubble collapse is next required to preserve sufficient porosity in the dry insulation after liquid removal. Conversion of said foamed liquid suspension to a gel condition can be carried out in various ways to include conventional freezing or employing already known chemical gelling agents such as ammonium chloride. The converted gel mass of fused silica particulates can thereafter be deposited in the metal dish for in situ removal of water employing conventional means such as drying at ordinary room or elevated temperatures, and the like.

In a different aspect of the present invention, a foamed liquid suspension of the fused silica particulates such as prepared in the above illustrated manner is initially deposited in the metal dish member of said radiant electric heater for preparation therein of the present solid porous insulation. Accordingly, the so constructed radiant electric heater includes a base layer of thermal and electrical insulation material, a metal heat shield interposed between said insulation material and said metal dish and a resistance heater element physically supported by said insulation material, said insulation material comprising a deposited porous solid mass formed with a foaming agent wherein said porous solid mass has non-porous fused silica particulates having an average particle size up to about 100 mesh United States screen size and with the porous characteristic being formed by void spaces between the deposited fused silica particulates, and with said porous solid mass of fused silica particulates having been formed by first depositing a foamed liquid suspension of the fused silica particulates and foaming agent in the metal dish then converting the deposited liquid suspension in situ to a gel condition and thereafter removing the liquid from the converted gel mass of fused silica particulates. Gelling in place of the deposited foamed liquid suspension as well as subsequent liquid removal from the converted gel mass can all be carried out in the above further illustrated manner. Thus, freezing of said already joined components of the radiant heater construction can be carried out in a routine manner as can drying said assembly for liquid removal from the already deposited insulation material. It can be further appreciated in connection with both of the above illustrated forms of radiant heater construction that appropriate installation of the metal heat shield component in said device will generally precede deposition of the foamed liquid insulation material in the metal dish.

In a still further modification contemplated for the present radiant electric heater construction, multiple preformed frozen pads of the foamed liquid insulation material are deposited in the metal dish for liquid removal in situ from the frozen insulation material. Said frozen insulation pads are physically stacked within the metal dish of the heater device with additional metal heat shields being placed between adjoining layers of insulation. By such means, heat retention can be adjusted in the present heater device to accommodate operating conditions of a particular cooking appliance without having to alter other components in the device construction itself. Additionally, lower bottom operating temperatures have been measured in the present heater construction when a multiple insulation layer configuration is employed.

BRIEF DESCRIPTION OF THE DRAWINGS

FIG. 1 is a cross sectional side view depicting a representative radiant electric heater construction of the present invention.

FIG. 2 is a graph illustrating heat retention in radiant heater devices of the present invention employing both single and dual insulation configurations.

DETAILED DESCRIPTION OF THE PREFERRED EMBODIMENTS

Referring to the drawings, FIG. 1 depicts a representative radiant electric heater construction of the present invention in cross section which can have a circular or rectangular shape when viewed from the top direction. Said radiant heater 10 includes a bottom metal dish member 12, a base layer pad 14 of porous solid fused silica particulates being deposited within said metal dish member according to the present invention, said base layer insulation pad 14 further having an integral upward extending rim 16 formed therein, a metal heat shield 18 being disposed between the bottom surface of said insulation pad and the top surface of the metal dish, and a conventional resistance heating element 20 being disposed on the top surface of said insulation pad. As can be further noted in the present drawing, the ring shaped rim 16 of said insulation pad protrudes slightly above the top of said metal dish member 12 in order to physically abut with the underside surface of a glass or ceramic top structure 22 generally employed in such type radiant heater cooking appliances. Preparation of a suitable insulation pad in said embodiment commenced with forming an aqueous slurry containing 1380 grams of the fused silica particulates having an average particle size of minus 100 mesh United States screen size combined with 1060 grams of the aforementioned colloidal silica binder and 20 grams of the also previously mentioned high foaming organic surfactant while continuously agitating said aqueous slurry in a conventional high speed rotary blender to produce a stable foam condition therein. Said foamed aqueous suspension was next deposited in a conventional mold having the shape of the herein depicted insulation pad before significant collapse of the bubble structure with the mold being rapidly cooled thereafter by liquid nitrogen until the mold contents had become frozen. Freezing of the foamed liquid suspension in said manner converted the foam liquid suspension to a gel condition for transfer of the still frozen insulation material to the herein depicted metal dish member. The frozen insulation pads being deposited in said metal dish member varied in thickness from 0.3 inch thick up to 0.7 inch thick. Inserting the depicted metal heat shield 18 in the metal dish preceded deposition of the frozen insulation in the present embodiment but said shield member can also be embedded in the bottom surface of said frozen insulation pad prior to its placement in dish member 12. Likewise, fastening the resistance heating element in the depicted embodiment can also be routinely carried out before or after the frozen insulation material is deposited in the metal dish member. Water was removed from the deposited frozen insulation in the present embodiment by heating the metal dish member and its contents to an elevated temperature in the range from about 300° F. to about 1200° F. over an average one hour drying time. Various metals were employed as the heat shield component in the illustrated heater embodiment to include stainless steel and aluminum foil. Heating tests were conducted upon six inch diameter and eight inch diameter circular radiant electric heater devices constructed in the foregoing manner at power levels ranging from 785 watts being applied to the six inch diameter units and 1396 watts being applied to the eight inch diameter units.

The graph in FIG. 2 illustrates performance characteristics for the present heater device when constructed in the above described manner with a single insulation pad or dual insulation pads. Curves 24 and 26 represent K type thermocouple measurements of temperature at the bottom surface of the dish member while the heater units were being operated at the above listed power levels. The temperatures were measured at one minute intervals during a thirty minute heating period for each of the different heater units. Curve 24 reports the bottom dish temperature for a single insulation pad device with a 0.7 inch pad thickness during said test period. The comparable measurements made upon the dual insulation pad devices having a 0.3 inch thick bottom pad and a 0.4 inch thick top pad are shown in curve 26. These results clearly indicate the suitability of the present radiant electric heater construction for general use in stop top cooking surfaces.

It will be apparent from the foregoing description that novel means have been provided to construct a radiant electric heater having versatile end product applications. It will be apparent, however, that various structural modifications can be made in the present heater device without departing from the spirit and scope of the present invention. For example, still other additives other than herein specifically disclosed can be incorporated into the disclosed insulation material without producing a deleterious effect such as colorants and the like. Likewise, it is contemplated that minor amounts of conventional additives to improve physical handling of the present insulation during processing or assembly of the heater unit in the present manner can be employed. Consequently, it is intended to cover all modifications of the disclosed heater construction which may be devised by persons skilled in the art as falling within the true spirit and scope of the present invention.

What we claim as new and desire to secure by Letters Patent of the United States is:

1. A radiant electric heater comprising a metal dish containing a base layer of thermal and electrical insulation material, a metal heat shield interposed between said insulation material and said metal dish and a resistance heating element physically supported by said insulation material, said insulation material comprising a solid porous mass of fused silica particulates formed in situ in the metal dish, said fused silica particulates having an average particle size up to about 100 mesh United States screen size and with non-porous characteristic being formed by void spaces between the fused silica particulates, and with said solid porous mass of fused silica particulates having been formed by first preparing a foamed liquid suspension of the fused silica particulates with a non-gaseous surfactant type foaming agent then converting the foamed liquid suspension to a gel condition and finally removing liquid from the converted gel mass of fused silica particulates after having been deposited in the metal dish.

2. The radiant heater of claim 1 wherein the base layer of insulation material is formed as a flat pad having the resistance heating element disposed on its top surface.

3. The radiant heater of claim 1 wherein the base layer of insulation material is formed as a flat pad with an integral upward extending rim.

4. The radiant heater of claim 1 wherein the base layer of insulation material is formed with multiple layers of the fused silica particulates physically separated with additional metal heat shields.

5. The radiant heater of claim 1 wherein the metal heat shield is physically embedded in the bottom surface of said insulation material.

6. The radiant heater of claim 1 wherein the metal heat shield comprises aluminum foil.

7. The radiant heater of claim 1 wherein foaming the liquid suspension of fused silica particulates and foaming agent is produced with physical agitation.

8. The radiant heater of claim 7 wherein the foam condition is produced with mechanical means at ordinary ambient temperature.

9. The radiant heater of claim 1 wherein the foamed liquid suspension is frozen to produce the gel condition.

10. The radiant heater of claim 1 wherein the foamed liquid suspension is converted to a gel condition with a chemical gelling agent.

11. The radiant heater of claim 1 wherein removing liquid from the converted gel mass of fused silica particulates is produced by heating said mass to an elevated temperature.

12. The radiant heater of claim 9 wherein the frozen liquid mass is heat dried to an elevated temperature for liquid removal therefrom.

13. The radiant heater of claim 1 wherein the liquid medium in the deposited mass of fused silica particulates and foaming agent is water.

14. The radiant heater of claim 1 wherein the foaming agent is an organic surfactant.

15. The radiant heater of claim 13 wherein the foaming agent is a water soluble organic surfactant.

16. The radiant heater of claim 9 wherein removing liquid from the converted gel mass of fused silica particulates is produced by heating said mass to an elevated temperature.

17. The radiant heater of claim 14 wherein the selected organic surfactant forms a sufficiently stable foam in the liquid suspension of fused silica particulates so as to avoid significant collapse of said foam before its conversion to a gel condition.

18. A radiant electric heater comprising a metal dish containing a base layer of thermal and electrical insulation material, a metal heat shield interposed between said insulation material and said metal dish and a resistance heating element physically supported by said insulation material, said insulation material comprising a deposited porous solid mass formed with a non-gaseous surfactant type foaming agent wherein said porous solid mass has non-porous fused silica particulates having an average particle size up to about 100 mesh United States screen size and with the porous characteristic being formed by void spaces between the deposited fused silica particulates, and with said solid porous mass of fused silica particulates having been formed by first depositing a foamed liquid suspension of the fused silica particulates and foaming agent in the metal dish then converting the deposited liquid suspension in situ to a gel condition and thereafter removing liquid from the converted gel mass of fused silica particulates.

19. The radiant heater of claim 18 wherein the deposited foam liquid suspension is frozen to produce the gel condition.

20. A radiant electric heater comprising a metal dish containing a base layer of thermal and electrical insulation material having an integral upward extending rim, a metal heat shield interposed between said insulation material and said metal dish, and a resistance heating element physically supported by said insulation base layer, said insulation material comprising a deposited porous solid foam mass formed with a non-gaseous organic surfactant foaming agent, wherein said porous mass has non-porous fused silica particulates having an average particle size up to about 100 mesh United States screen size and with the porous characteristic being formed by void spaces between the deposited fused silica particulates, and with said solid porous mass of fused silica particulates having been formed by first depositing a foamed aqueous suspension of the fused silica particulates and organic surfactant foaming agent in the metal dish then freezing the deposited liquid suspension in situ to produce a gel condition therein and thereafter heat drying the frozen liquid mass at an elevated temperature until water has been removed therefrom.

21. The radiant heater of claim 20 wherein the base layer of insulation further includes multiple layers of fused silica particulates physically separated with additional heat shields.

* * * * *